US010099274B2

(12) United States Patent
Tsutsumi

(10) Patent No.: US 10,099,274 B2
(45) Date of Patent: Oct. 16, 2018

(54) EVAPORATIVE PATTERN CASTING METHOD

(71) Applicant: Kobe Steel, Ltd., Hyogo (JP)

(72) Inventor: Kazuyuki Tsutsumi, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 44 days.

(21) Appl. No.: 15/520,009

(22) PCT Filed: Oct. 21, 2015

(86) PCT No.: PCT/JP2015/079751
§ 371 (c)(1),
(2) Date: Apr. 18, 2017

(87) PCT Pub. No.: WO2016/080139
PCT Pub. Date: May 26, 2016

(65) Prior Publication Data

US 2017/0312811 A1 Nov. 2, 2017

(30) Foreign Application Priority Data

Nov. 19, 2014 (JP) ..... 2014-234455

(51) Int. Cl.
*B22C 9/04* (2006.01)
*B22C 3/00* (2006.01)
*B22C 7/02* (2006.01)

(52) U.S. Cl.
CPC ..... *B22C 7/023* (2013.01); *B22C 3/00* (2013.01); *B22C 7/02* (2013.01); *B22C 9/046* (2013.01)

(58) Field of Classification Search
CPC ..... B22C 21/14; B22C 7/02; B22C 7/023; B22C 9/04; B22C 9/046
(Continued)

(56) References Cited

U.S. PATENT DOCUMENTS 5,203,398 A * 4/1993 Easwaran ..... B22C 9/046 164/34
5,848,351 A 12/1998 Hoshino et al.
(Continued)

FOREIGN PATENT DOCUMENTS

JP S63-183744 A 7/1988
JP 01154847 A * 6/1989 ..... B22C 9/046
(Continued)

OTHER PUBLICATIONS

International Search Report issued in PCT/JP2015/079751; dated Nov. 17, 2015.
(Continued)

*Primary Examiner* — Kevin E Yoon
(74) *Attorney, Agent, or Firm* — Studebaker & Brackett PC

(57) ABSTRACT

In the following expression, it is assumed that a thickness of a coating agent applied to a foam pattern [2] is t (mm), a diameter of a hole part [3] is D (mm), and a normal-temperature transverse strength of the dried coating agent is σc (MPa). At the time of producing a casting provided with a hole having a diameter of 18 mm or smaller and a length of 1 (mm), a coating agent that satisfies the following expression is used when a solidification end time te (sec) at which solidification of a melt ends on a periphery of the hole part [3] is within a time t0 (sec) at which thermal decomposition of the coating agent ends.

$$\sigma c \geq \{t0/(t0-te)\} \times (1.5\times10^{-4}\times1^2/t^2+160/D^2)$$

4 Claims, 13 Drawing Sheets

(58) Field of Classification Search
USPC ..... 164/34–36
See application file for complete search history.

(56) References Cited

U.S. PATENT DOCUMENTS

| | | | | |
|---|---|---|---|---|
| 6,117,592 | A | 9/2000 | Hoshino et al. | |
| 2007/0272387 | A1* | 11/2007 | Hirukawa ..... | B22D 27/20 164/65 |
| 2012/0273151 | A1 | 11/2012 | Hirai et al. | |

FOREIGN PATENT DOCUMENTS

| | | | |
|---|---|---|---|
| JP | H01-266941 | A | 10/1989 |
| JP | 2003-290873 | A | 10/2003 |
| JP | 2011-110577 | A | 6/2011 |
| TW | 381981 | B | 2/2000 |

OTHER PUBLICATIONS

Notification of Transmittal of Translation of the International Preliminary Report on Patentability (Chapter I) and Translation of Written Opinion of the International Searching Authority; PCT/JP2015/079751; dated Jun. 1, 2017.

* cited by examiner

EVAPORATIVE PATTERN CASTING METHOD

CROSS-REFERENCE TO RELATED APPLICATIONS

This is a national phase application in the United States of International Patent Application No. PCT/JP2015/079751 with an international filing date of Oct. 21, 2015, which claims priority of Japanese Patent Application No. 2014-234455 filed on Nov. 19, 2014 the contents of which are incorporated herein by reference.

TECHNICAL FIELD

The present invention relates to an evaporative pattern casting method for producing a casting provided with a hole.

BACKGROUND ART

In contrast to a common sand casting method, several methods have been proposed to produce a casting with excellent dimensional accuracy. For example, the investment casting method (also called as lost-wax method), the plaster mold casting method, and the evaporative pattern casting method have been developed.

Among those methods, the evaporative pattern casting method is considered as the most suitable method to form a hole inside a casting by casting (this formation is referred to as "hole casting"). The evaporative pattern casting method is a method for producing a casting by burying into casting sand a mold, which is formed by application of a coating agent to the surface of a foam pattern, and then pouring a metal melt into the mold to cause the foam pattern to disappear and be replaced with the melt.

JP 2011-110577 A discloses an evaporative pattern casting method to set casting time during casting in accordance with a pattern modulus (a pattern volume divided by a pattern surface area).

SUMMARY OF INVENTION

Problems to be Solved by the Invention

In the evaporative pattern casting method, during casting (in the process of solidification), the coating agent applied to the surface of the hole part in the foam pattern and the casting sand that fills the inside of the hole part are under a large thermal load from surroundings and are acted on by a variety of external forces from the melt. Note that the hole part in the foam pattern is a portion where a hole is formed by the hole casting. Thus, as shown in FIG. 18 being a conceptual view, a coating agent 24 may be damaged at a hole edge 23*a* or a center part 23*b* of a hole part 23, and a melt 26 may seep into casting sand 25 that fills the inside of the hole part 23. Especially when a narrow hole with a diameter of 18 mm or smaller is to be cast, damage occurs on the coating agent 24 to bring about "burning", which is fusion of the melt 26 and the casting sand 25, thereby making it difficult to form a narrow hole in a good finished state.

Hence usually, a narrow hole with a diameter of 18 mm or smaller and a length of 50 mm or larger is not cast, but is later made in a produced casting by mechanical processing. Alternatively, a trial casting is produced several times to decide a material for the coating agent and a casting condition (a temperature of the melt when poured), based on which the narrow hole with a diameter of 18 mm or smaller and a length of 50 mm or larger is cast, but stable production is difficult.

It is an object of the present invention to provide an evaporative pattern casting method capable of casting a narrow hole having a diameter of 18 mm or smaller and being in a good finished state.

Means for Solving the Problems

An evaporative pattern casting method according to the present invention is a method for producing a casting provided with a hole having a diameter of 18 mm or smaller and a length of 1 (mm) by burying into casting sand a mold, which is formed by application of a coating agent to a surface of a foam pattern, and then pouring a metal melt into the mold to cause the foam pattern to disappear and be replaced with the melt, and in the method, assuming that a thickness of the coating agent applied to the foam pattern is t (mm), a diameter of a hole part in the foam pattern, which is a portion to be formed with the hole, is D (mm), and a normal-temperature transverse strength of the dried coating agent is σc (MPa), the coating agent that satisfies the following expression is used when a solidification end time to (sec) at which solidification of the melt ends on a periphery of the hole part is within a time t0 (sec) at which thermal decomposition of the coating agent ends.

$$\sigma c \geq \{t0/(t0-te)\} \times (1.5\times10^{-4}\times 1^2/t^2+160/D^2)$$

EFFECT OF THE INVENTION

According to the present invention, at the time of producing a casting provided with a hole having a diameter of 18 mm or smaller and a length of 1 (mm), the coating agent that satisfies the above expression is used when the solidification end time te (sec) at which the solidification of the melt ends on the periphery of the hole part is within the time t0 at which the thermal decomposition of the coating agent ends. In this context, directly measuring the strength of the coating agent at high temperature is difficult. However, from the fact that the transverse strength of the coating agent, having been heated until decomposition of resin to become a sintered body and then returned to room temperature, decreases to or below about one seventh of the normal-temperature transverse strength as a resin bonded body formed by drying the coating agent as it is, the transverse strength of the coating agent having yet to completely end the resin decomposition, namely yet to become a complete sintered body, is presumed to be higher than the transverse strength of the coating agent that has become a complete sintered body. The strength of the coating agent as the resin bonded body is σc at room temperature, which decreases with the progress of thermal decomposition of the resin, and becomes 0 at a decomposition rate of 100%. However, when the solidification end time te (sec) at which the solidification of the melt ends on the periphery of the hole part is within the time t0 (sec) at which the thermal decomposition of the coating agent ends, the strength as the resin bonded body remains in the coating agent. Considering the strength as the resin bonded body which remains in the coating agent, the above expression is obtained. Hence the use of the coating agent that satisfies the above expression can keep the coating agent from being damaged even when a casting provided with a narrow hole having a diameter of 18 mm or smaller is produced. This prevents occurrence of the burning during casting, to allow casting of a narrow hole having a diameter of 18 mm or smaller and being in a good finished state.

DESCRIPTION OF EMBODIMENTS

Figure 1A:
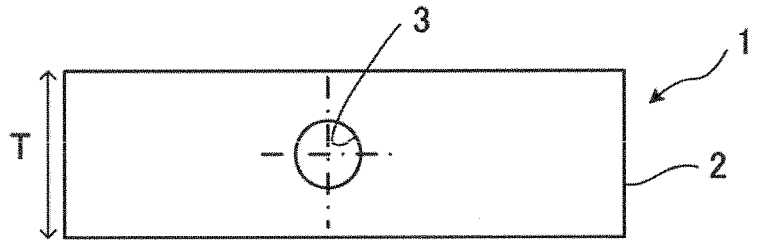
FIG. 1A is a top view of a mold.

A preferred embodiment of the present invention will be described below with reference to the drawings.

(Evaporative Pattern Casting Method)

An evaporative pattern casting method according to an embodiment of the present invention is a method for producing a casting provided with a hole having a diameter of 18 mm or smaller and a length of 1 (mm) by burying into casting sand (dry sand) a mold, which is formed by application of a coating agent to the surface of a foam pattern, and then pouring a metal melt into the mold to cause the foam pattern to disappear and be replaced with the melt. This evaporative pattern casting method is considered as the most suitable method for producing, by "hole casting", a casting provided with a narrow hole having a diameter of 18 mm or smaller and a length of 100 mm or larger, for example.

The evaporative pattern casting method includes a dissolution step of melting metal (casting iron) into a melt, a shaping step of shaping a foam pattern, and an application step of applying a coating agent to the surface of the foam pattern to obtain a mold. The evaporative pattern casting method then includes a molding step of burying the mold into casting sand to fill every corner of the mold with the casting sand, and a casting step of pouring the melt (melted metal) into the mold to melt and replace the foam pattern with the melt. The evaporative pattern casting method further includes a cooling step of cooling the melt poured into the mold to obtain a casting, and a separation step of separating the casting and the casting sand.

As the metal to be melted into the melt, gray cast iron (JIS-FC250), spheroidal graphite cast iron (JIS-FCD450), or the like is usable. As the foam pattern, foam resin such as styrene foam is usable. As the coating agent, a coating agent of a silica-based aggregate or the like is usable. As the casting sand, "silica sand" mainly composed of $SiO_2$, zircon sand, chromite sand, synthesized ceramic sand, or the like is usable. Note that a binder or a curing agent may be added to the casting sand.

A thickness of the coating agent is preferably 3 mm or smaller. This is because, when the thickness of the coating agent is 3 mm or larger, application and drying of the coating agent need to be repeated three times or more, which takes much time and makes the thickness easily become non-uniform.

At the time of producing the casting provided with a hole having a diameter of 18 mm or smaller and a length of 1 (mm), in the present embodiment, the coating agent that satisfies Expression (1) below is used when a solidification end time te (sec) is within a time t0 (sec). The solidification end time te (sec) is a time at which the solidification of the melt ends on the periphery of the hole part in the foam pattern. The time t0 (sec) is a time at which thermal decomposition of the coating agent ends. Note that the hole part in the foam pattern is a portion where a hole is formed by the hole casting.

$$\sigma c \geq \{t0/(t0-te)\} \times (1.5\times10^{-4}\times l^2/t^2+160/D^2) \qquad \text{Expression (1)}$$

where 1 is a length (mm) of the hole that is formed in the casting, t is a thickness (mm) of the coating agent that is applied to the foam pattern, D is a diameter (mm) of the hole part in the foam pattern, and ac is a normal-temperature transverse strength (bending strength) (MPa) of the dried coating agent.

Figure 1B:
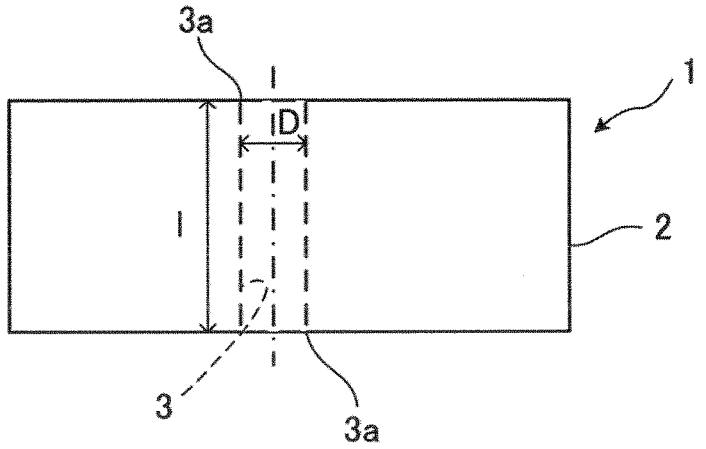
FIG. 1B is a side view of the mold.

FIG. 1A is a top view of a mold, and FIG. 1B is a side view of the mold. As shown in FIGS. 1A and 1B, there will be considered a case where the casting provided with the narrow hole having a diameter of 18 mm or smaller and a length of 1 (mm) is produced using a mold 1 with a hole part 3 having a diameter of D (mm) and the length of 1 (mm) and provided through a center part of a foam pattern 2 in a rectangular parallelepiped shape from its upper surface to lower surface. Note that the hole part 3 is provided such that an angle is formed at its hole edge 3*a* with respect to the plane of the foam pattern 2. That is, the hole edge 3*a* is not subjected to processing such as tapering. A diameter D of the hole part 3 is a length between the surfaces of the hole part 3 with a center line of the hole part 3 located therebetween, and the diameter D is not a length between the surfaces of the coating agent applied to the surface of the hole part 3.

The diameter of the narrow hole is preferably 10 mm or larger. Further, the diameter of the narrow hole is more preferably 18 mm or smaller. This is because, when a coating agent with a thickness of 3 mm is applied to the surface of a narrow hole with a diameter of 10 mm, an internal diameter of a space inside the narrow hole becomes 4 mm, which makes it difficult to put the casting sand into the narrow hole.

First, in accordance with basic casing conditions, a load which acts on the coating agent applied to the surface of the hole part 3 in the foam pattern 2 is estimated. When the narrow hole is provided along a vertical direction, the following external force acts on the coating agent applied to the hole edge 3*a* of the hole part 3.

(1) Static pressure (σp) of the melt (2) Dynamic pressure (σm) by a flow of the melt (3) A difference (σthout) in thermal contraction/expansion between the coating agent and the melt at the time of solidification (4) A difference (σthin) in thermal contraction/expansion between the casting sand and the coating agent in the hole part 3

(5) Pressure (Pgout) (σTout) of gas generated by combustion of the foam pattern (6) Internal pressure (Pgin) (σgin) generated by accumulation of gas, generated by combustion of the foam pattern, inside the hole part 3

Assuming that the strength (hot strength) of the coating agent at a high temperature which is equivalent to a temperature of the melt (melted metal) is σb, when Expression (2) below holds, the "hole casting" is possible without occurrence of "burning" of the melt and the casting sand due to damage on the coating agent.

$$\sigma b > \sigma p + \sigma m + \sigma th\text{out} + \sigma th\text{in} + \sigma\text{gout} + \sigma\text{gin} \qquad \text{Expression (2)}$$

Each external force will be considered below.

(Static Pressure of Melt)

Figure 2:
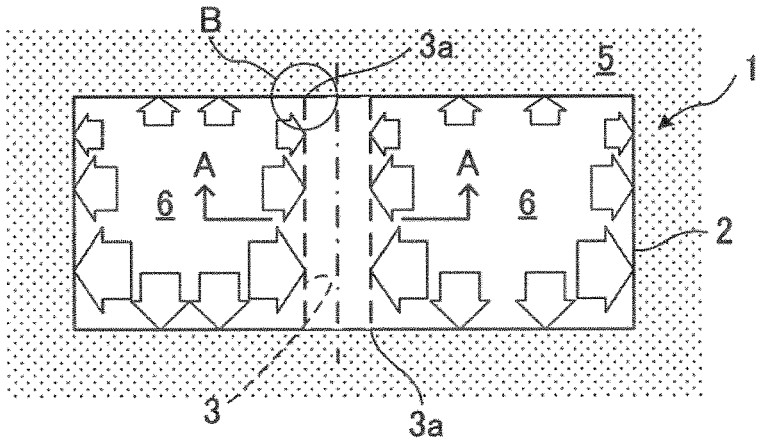
FIG. 2 is a side view of the mold.
Figure 3:
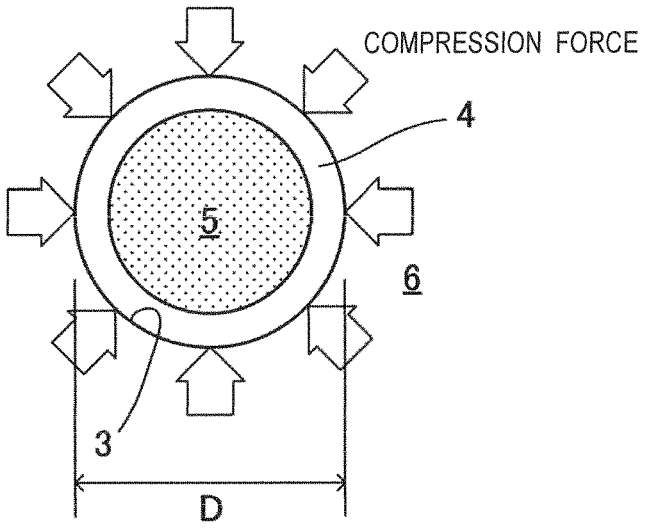
FIG. 3 is an A-A sectional view of FIG. 2.

As shown in FIG. 2 being a side view of the mold 1, when the foam pattern 2 is caused to disappear and be replaced with the melt 6, casting sand 5 that fills the periphery of the foam pattern 2 receives static pressure of the melt 6. As shown in FIG. 3 being an A-A sectional view of FIG. 2, a coating agent 4 applied to the surface of the hole part 3 receives compression force in a circumferential direction.

Figure 4:
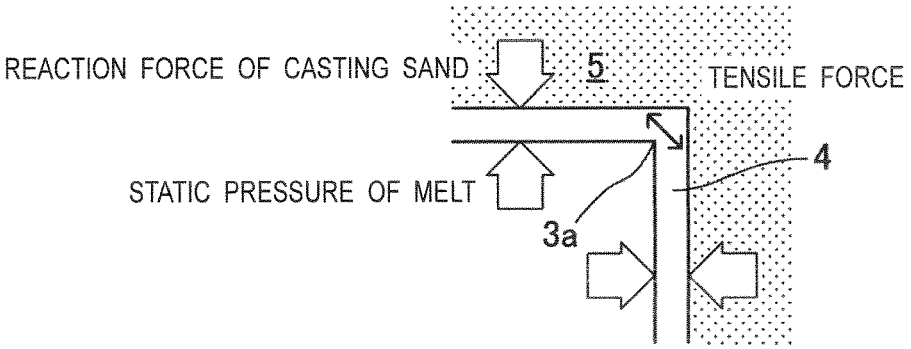
FIG. 4 is an enlarged view of a main part B of FIG. 2.

When an amount of the casting sand 5 that fills the periphery of the foam pattern 2 is sufficient, as shown in FIG. 4 being an enlarged view of a main part B of FIG. 2, the static pressure of the melt 6 and the reaction force from the casting sand 5 balance each other in the coating agent 4 applied to the hole edge 3*a*. Hence a load in an axial direction of the hole part 3 is negligible.

On the other hand, when the amount of the casting sand 5 that fills the inside of the hole part 3 is insufficient, bending stress due to the static pressure (buoyant force) of the melt 6 acts on the coating agent 4 applied to the hole edge 3*a*.

It is assumed that a diameter of the hole part 3 is D (mm), an acceleration of gravity is g, and a density of the melt 6 is ρm (kg/mm$^3$). It is assumed that external force w (N/mm) applied to the hole part 3 (half circle) due to the static pressure of the melt 6 can be obtained by Expression (3) below, with an average head difference (a difference in vertical height between an inlet for the melt and the hole part 3) taken as h (mm). Note that the inlet for the melt is a place where an opening is formed in the casting sand that surround the foam pattern above the hole part, and the melt is poured.

$$w = \rho mgh \times \int (D/2 \sin\theta \times \theta) d\theta$$

$$= \rho mghD/2 \times \int \sin^2\theta d\theta$$

$$= \rho mghD/2[\theta/2 - \sin 2\theta/4] = (\pi/4)\rho mghD \qquad \text{Expression (3)}$$

When the stress that acts on the coating agent 4 having a thickness t (mm) and applied to the surface of the hole part 3 is approximated to a plate assuming that there is no reaction force from the casting sand 5 that fills the inside of the hole part 3, σc (MPa) in Expression (4) below is obtained from the beam theory.

$$\sigma c \approx M/I \times t/2 = (\pi/8)\rho mghl^2/t^2 \qquad \text{Expression (4)}$$

where M is a moment that acts on both ends of the hole part 3, and I is a sectional secondary moment of a half cylinder.

$$M = (\pi/48)\rho mghDl^2 I = Dt^3/12$$

(Dynamic Pressure Due to Flow of Melt)

The dynamic pressure due to the flow of the melt is negligible based on the premise that the flow of the melt is gentle.

(Difference in Thermal Contraction/Expansion Between Coating Agent and Melt at Time of Solidification)

A linear expansion rate of the casting iron is higher than that of the casting sand. Hence a difference in thermal contraction/expansion between the coating agent and the melt at the time of solidification causes application of compression force in the axial direction of the coating agent. This compression force could cause destruction of a circular tube formed of the coating agent due to buckling, but is considered as negligibly small. Further, stress in the circumferential direction of the coating agent is also negligible.

(Difference in Thermal Contraction/Expansion Between Casting Sand and Coating Agent in Hole Part)

Changes in temperatures of the casting sand and the coating agent in the hole part 3 are smaller than that of the melt. Hence an influence due to the difference in thermal contraction/expansion between the casting sand and the coating agent in the hole part 3 is smaller than an influence due to the difference in thermal contraction/expansion between the coating agent and the melt at the time of solidification, and is thus negligible.

(Pressure of Gas Generated by Combustion of Foam Pattern)

Figure 5:
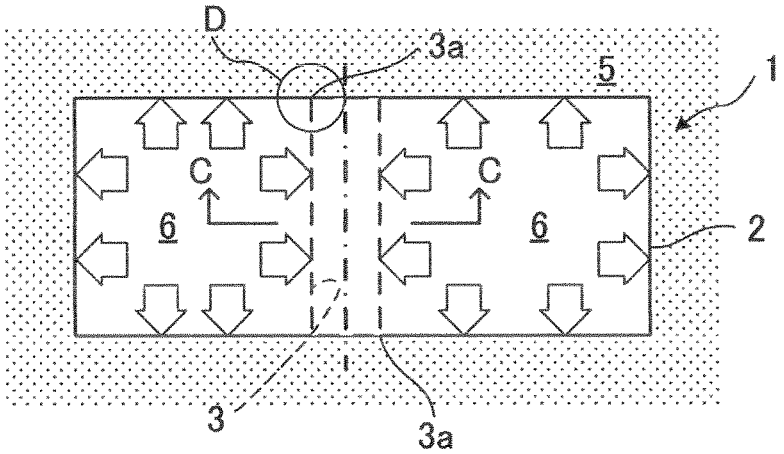
FIG. 5 is a side view of the mold.

As shown in FIG. 5 being a side view of the mold 1, when the foam pattern 2 is caused to disappear and be replaced with the melt 6, the casting sand 5 that fills the periphery of the foam pattern 2 receives pressure of gas generated by combustion of the foam pattern 2.

Figure 6:
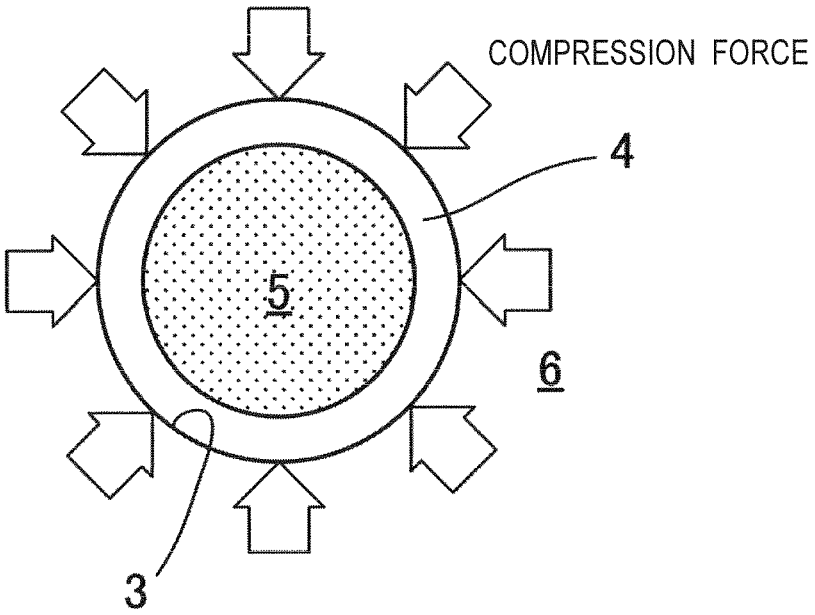
FIG. 6 is a C-C sectional view of FIG. 5.

As shown in FIG. 6 being a C-C sectional view of FIG. 5, the coating agent 4 applied to the surface of the hole part 3 receives compression force in the circumferential direction. However, as shown in FIG. 7 being an enlarged view of a main part D of FIG. 5, tensile force of Expression (5) below is applied in the axial direction of the hole part 3.

$$\sigma\text{out} \propto \text{Pgout}/D^2 \qquad \text{Expression (5)}$$

Figure 7:
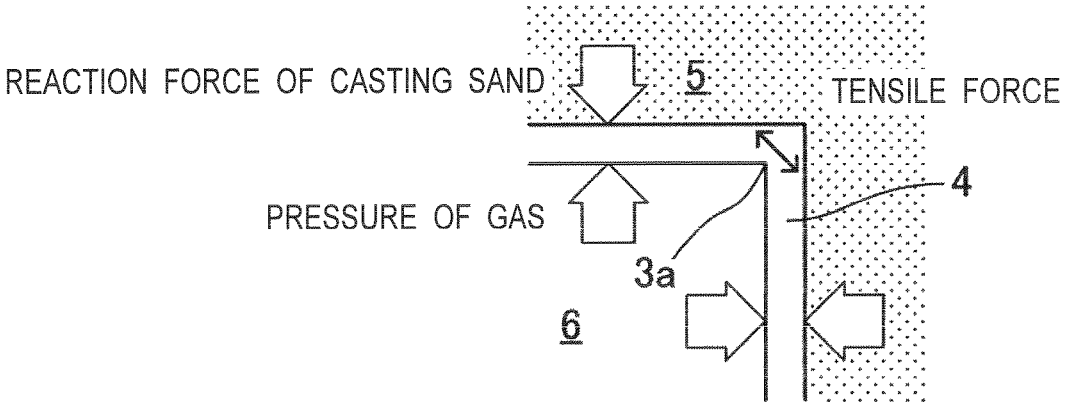
FIG. 7 is an enlarged view of a main part D of FIG. 5.

As shown in FIG. 7, when the amount of the casting sand 5 that fills the periphery of the foam pattern 2 is sufficient, the pressure of the gas and the reaction force from the casting sand 5 balance each other, and the load in the axial direction of the hole part 3 is thus negligible.

(Internal Pressure Generated by Accumulation of Gas, Generated by Combustion of Foam Pattern, Inside Hole Part) The internal pressure generated by accumulation of gas, generated by combustion of the foam pattern 2, inside the hole part 3 causes the coating agent to generate stress in the circumferential direction in Expression (6) and stress in the axial direction in Expression (7).

$$\sigma\text{gin} \approx D \times P\text{gin}/t \qquad \text{Expression (6)}$$

$$\sigma\text{ginz} \approx D \times P\text{gin}/(2t) \qquad \text{Expression (7)}$$

The smaller the diameter D of the hole part 3, the more difficult the hole casting, and it can thus be said that an influence of the external force expressed by each of Expressions (6) and (7) is negligibly small.

From the above, when a filling amount of the casting sand is sufficient, the load on the coating agent is small. In practice, however, the reaction force from the casting sand is not sufficient, and the bending stress generated due to the static pressure of the melt and the tensile force in the axial direction due to the pressure of the gas generated by combustion of the foam pattern 2 act on the coating agent. This requires the coating agent to have the hot strength large enough to withstand these stress and force. Accordingly, as a condition for the hole casting, Expression (2) can be approximated to Expression (8) by using Expressions (4) and (5).

$$\sigma b > \sigma p + \sigma gout = (\pi/8)\rho mghl^2/t^2 + kPgout/D^2 + \gamma \quad \text{Expression (8)}$$

where k is a proportional constant, and $\gamma = \sigma m + \sigma thout + \sigma thin + \sigma gin \approx 0$.

Expression (8) is the strictest condition which holds only when there is no reaction force of the casting sand. Then, adding the reaction force of the casting sand and replacing each term with a coefficient gives a function of the diameter D and the length l of the hole part 3 and the thickness t of the coating agent, as in Expression (9).

$$\sigma b > \alpha \cdot 1^2/t^2 + \beta/D^2 \quad \text{Expression (9)}$$

Figure 8:
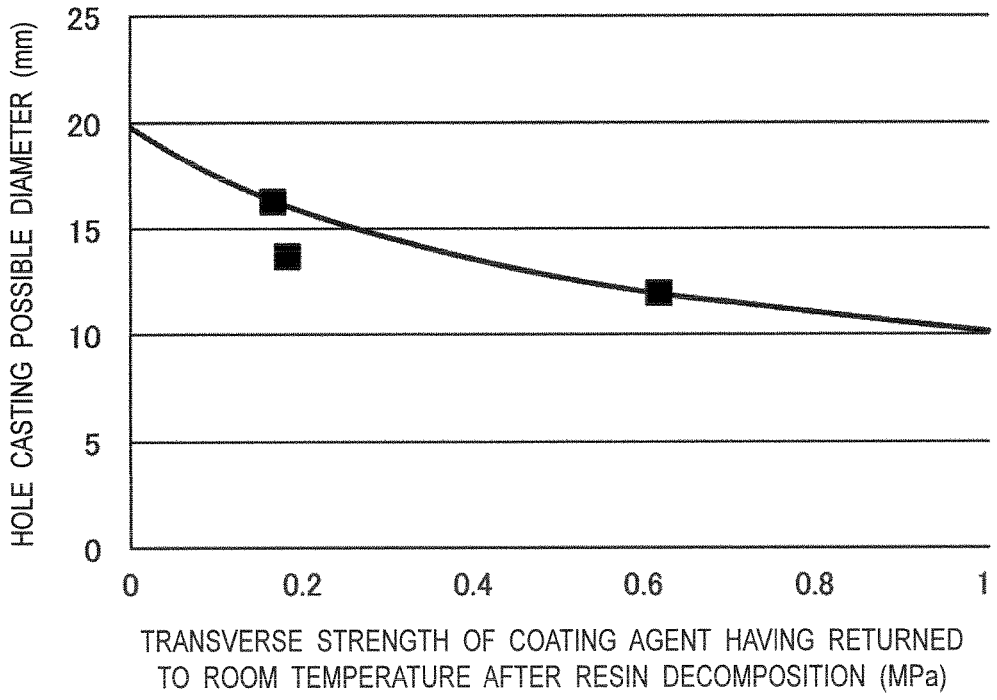
FIG. 8 is a diagram showing the relation between a transverse strength of a coating agent having been heated until decomposition of resin and then returned to room temperature, and a hole casting possible diameter.

In this context, directly measuring the hot strength of the coating agent is difficult. Then, in place of the hot strength σb (MPa) of the coating agent, the transverse strength σn (MPa) of the coating agent is used, the coating agent having been heated until decomposition of the resin and then returned to room temperature. FIG. 8 shows the relation between the transverse strength of the coating agent having been heated until decomposition of the resin and then returned to room temperature, and a diameter of a hole part that can be cast (hole casting possible diameter). Based on this relation, Expression (9) can be expressed by Expression (10).

$$\sigma n \geq -0.36 + 140/D^2 \quad \text{Expression (10)}$$

Accordingly, using the coating agent that satisfies Expression (10) above and setting the thickness of the coating agent applied to the foam pattern to 1 mm or larger can keep the coating agent from being damaged even when a casting is produced which is provided with a narrow hole having a diameter of 18 mm or smaller and a length of 100 mm or larger.

(Transverse Strength of Coating Agent)

Expression (10) above is obtained using a mold which has a 100-mm short side of a cross section orthogonal to the axial direction of the hole part. Until the solidification of the melt is completed on the periphery of the hole part, the coating agent in the hole part has become a sintered body. Thus, for preventing occurrence of the "burning", the hot strength of the coating agent as the sintered body needs to exceed a total of external force including the buoyant force.

Meanwhile, when the short side (a short side T of FIG. 1A) of the cross section in the mold which is orthogonal to the axial direction of the hole part becomes smaller, the time required until completion of solidification of the melt on the periphery of the hole part becomes shorter. In this case, when the solidification of the melt is completed on the periphery of the hole part, the decomposition of the resin constituting the coating agent has seemingly yet to end completely, namely the coating agent has seemingly yet to become a complete sintered body.

As described later, the transverse strength cm of the coating agent, having been heated until decomposition of the resin to become a sintered body and then returned to room temperature, decreases to or below about one seventh of the normal-temperature transverse strength ac as a resin bonded body formed by drying the coating agent as it is. Accordingly, the transverse strength of the coating agent having yet to completely end the resin decomposition, namely yet to become a complete sintered body, is presumed to be higher than the transverse strength σn of the coating agent that has become a complete sintered body.

Figure 9:
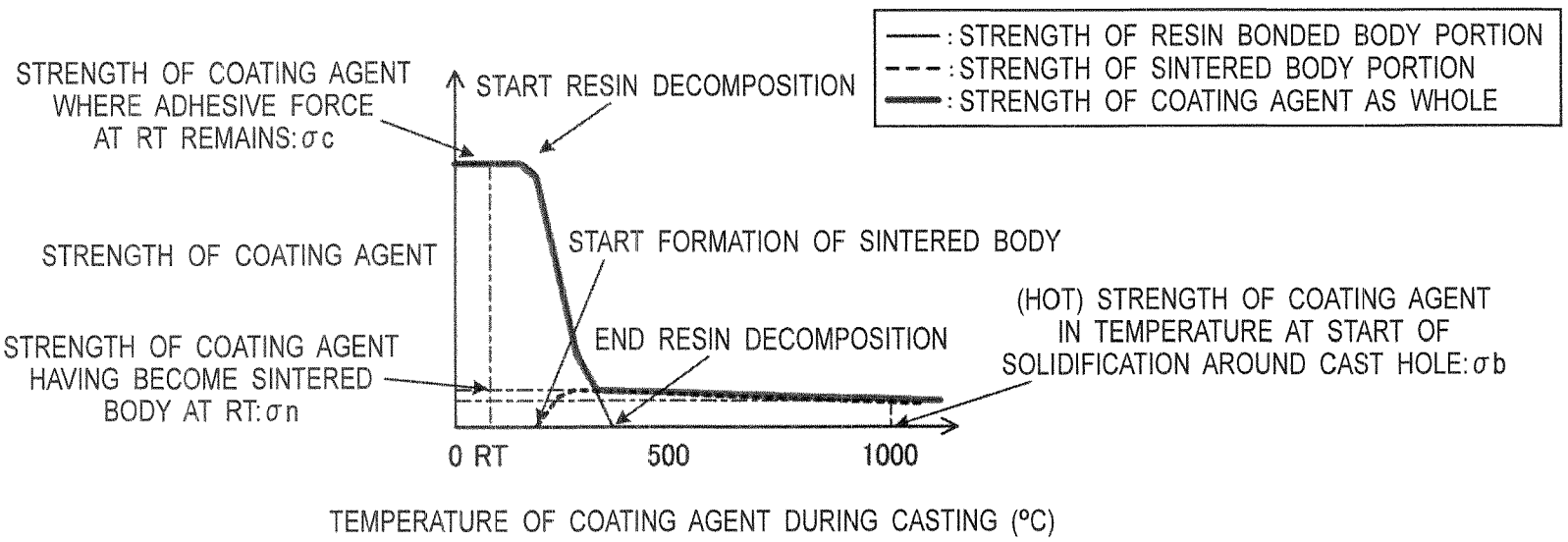
FIG. 9 is a diagram showing the relation between a temperature of the coating agent and a strength of the coating agent during casting.

FIG. 9 shows the relation between the temperature of the coating agent and the strength of the coating agent during casting. At room temperature (RT), the transverse strength of the coating agent is σc, and the strength of the coating agent is decided based on bonding force of an aggregate made of resin (strength as the resin bonded body). Upon start of the resin decomposition of the coating agent by heating, the strength of the coating agent decreases with the progress of thermal decomposition of the resin. Upon complete end of the resin decomposition, the transverse strength of the coating agent becomes the transverse strength cm of the coating agent having become the sintered body and then returned to room temperature (RT).

Figure 10:
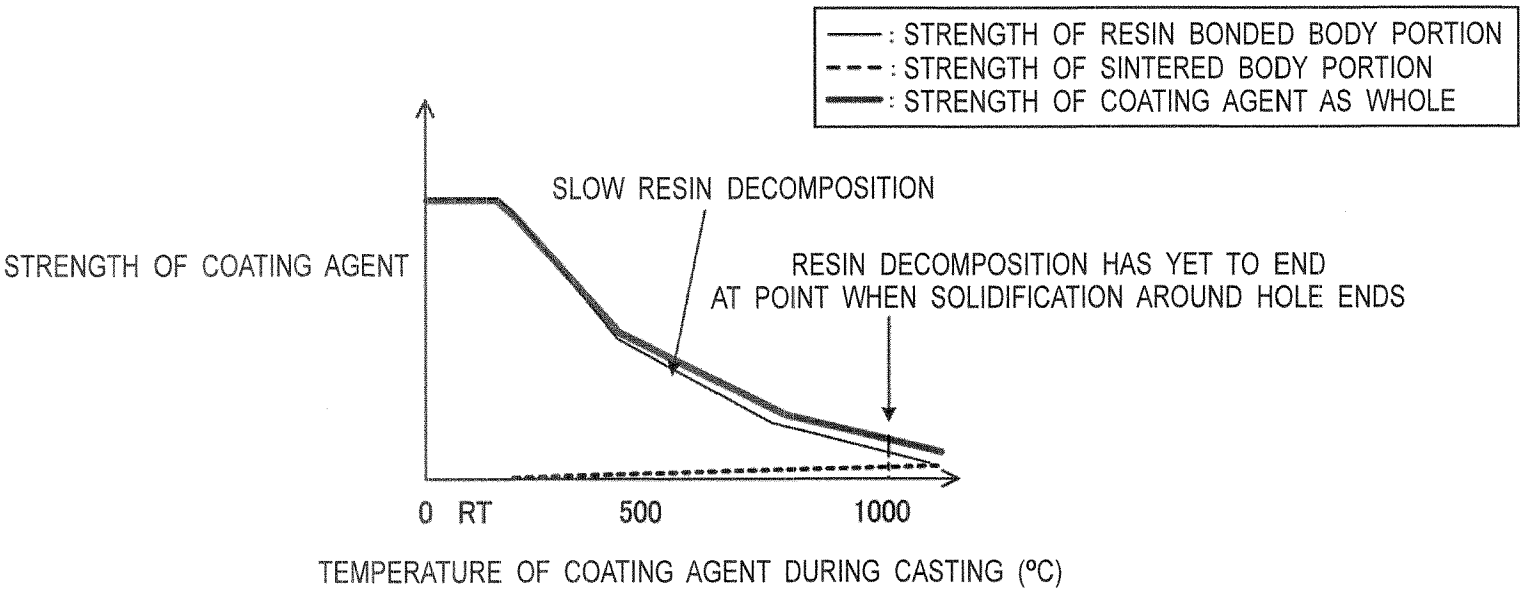
FIG. 10 is a diagram showing the relation between the temperature of the coating agent and the strength of the coating agent during casting.

When the time until the end of the solidification of the melt on the periphery of the hole part is long, as shown in FIG. 9, the resin decomposition of the coating agent ends completely and the coating agent becomes a sintered body before the solidification of the melt ends on the periphery of the hole part. FIG. 10 shows the relation between the temperature of the coating agent and the strength of the coating agent during casting. As shown in FIG. 10, when the time until the end of the solidification of the melt on the periphery of the hole part is short, upon end of the solidification of the melt, the resin decomposition of the coating agent has seemingly yet to end completely, namely yet to become a complete sintered body. When the coating agent has yet to become the complete sintered body, the strength as the resin bonded body remains in the coating agent, and that strength is presumed to be higher than the transverse strength cm of the coating agent having become the sintered body.

Accordingly, when the solidification of the melt on the periphery of the hole part ends before the thermal decomposition of the coating agent ends, the strength as the resin bonded body remains in the coating agent. In other words, when the solidification end time te (sec) at which the solidification of the melt ends on the periphery of the hole part is within the time t0 (sec) at which the thermal decomposition of the coating agent ends, the strength as the resin bonded body remains in the coating agent. Then, the transverse strength of the coating agent having yet to become the complete sintered body is presumed to be higher than the transverse strength cm of the coating agent that has become the complete sintered body. It can thus be said that, when the strength as the resin bonded body remains in the coating agent, the coating agent is hardly damaged and the "burning" hardly occurs.

A reaction rate equation of thermal decomposition of the resin used for the coating agent is expressed by Expression (11) below.

$$kt = f(\alpha) \quad \text{Expression (11)}$$

where k is a reaction rate constant, t is reaction time (sec), α is a decomposition rate, and $f(\alpha)$ is a function of the decomposition rate α.

Then, the hot strength σb of the coating agent is expressed by Expression (12) upon completion of the solidification of the melt on the periphery of the hole part (t=te).

$$\sigma b = g(\alpha) = g(f^{-1}(kte)) = h(te) \quad \text{Expression (12)}$$

where g(α) is a function to decide the hot strength σb at the decomposition rate α.

Since h(te) can be expressed by $g(f^{-1})$, the hot strength σb becomes a function of the time until completion of solidification.

As described later, the time t0 at which the thermal decomposition of the coating agent ends can be approximated to 1600 seconds. When the solidification end time te (sec) at which the solidification of the melt ends on the periphery of the hole part is within the time t0 (sec) at which the thermal decomposition of the coating agent ends, it can be said that the strength as the resin bonded body remains in the coating agent, to thereby give Expression (13).

$$te \geq t0 \approx 1600 \text{ (sec)} \quad \text{Expression (13)}$$

From an experimental result (detailed later) in the mold having the 100-mm short side of the cross section orthogonal to the axial direction of the hole part, α and β in Expression (9) are obtained to give Expression (14) below.

$$\sigma b > 1.5\times10^{-4}\times1^2/t^2+160/D^2 \quad \text{Expression (14)}$$

When the resin decomposition in the coating agent has yet to end, namely when the solidification end time te at which the solidification of the melt ends on the periphery of the hole part is within the time t0 at which the thermal decomposition of the coating agent ends, Expression (14) can be approximated as in Expression (15) below by using the transverse strength σc of the coating agent as the resin bonded body.

$$k\sigma c \geq 1.5\times10^{-4}\times1^2/t^2+160/D^2 \quad \text{Expression (15)}$$

where k is a coefficient that changes in accordance with a resin decomposition status.

At the resin decomposition rate of 0%, the hot strength of the coating agent is σb=σc, and at the decomposition rate of 100%, σb=0 (in practice, the coating agent has the strength as the sintered body). Assuming that Expression (12) is a primary expression, Expression (16) is given as below.

$$k = 1 - te/t0 \quad \text{Expression (16)}$$

Substituting Expression (16) into Expression (15) gives Expression (17). The use of the coating agent that satisfies this Expression (17) can prevent the "burning" from occurring.

$$\sigma c \geq \{t0/(t0-te)\}\times(1.5\times10^{-4}\times1^2/t^2+160/D^2) \quad \text{Expression (17)}$$

Further, substituting Expression (13) into Expression (17) gives Expression (18) below.

$$\sigma c \geq \{1600/(1600-te)\}\times(1.5\times10^{-4}\times1^2/t^2+160/D^2) \quad \text{Expression (18)}$$

Note that the shape of the mold is not restricted to a rectangular parallelepiped, but may be a prismatic shape or a cylindrical shape such as a triangular prism or a pentagonal prism.

When the shape of the mold is a rectangular parallelepiped, as described later, the solidification end time te at which the solidification of the melt ends on the periphery of the hole part can be expressed by a function of the short side T (cf. FIG. 1A) of the cross section in the mold which is orthogonal to the axial direction of the hole part. When common casting sand is used for casting, the solidification end time te at which the solidification of the melt ends on the periphery of the hole part can be approximated by Expression (19).

$$te = -1.03\times10^{-3}T^2+16.5T \quad \text{Expression (19)}$$

Substituting Expression (17) into Expression (19) gives Expression (20).

$$\sigma c \geq t0/(t0+1.03\times10^{-3}T^2-16.5T)\times(1.5\times10^{-4}\times1^2/t^2+160/D^2) \quad \text{Expression (20)}$$

Substituting Expression (19) into Expression (18) gives Expression (21).

$$\sigma c \geq 1600/(1600+1.03\times10^{-3}T^2-16.5T)\times(1.5\times10^{-4}\times1^2/t^2+160/D^2) \quad \text{Expression (21)}$$

(Hole Casting Evaluation)

Figure 11A:
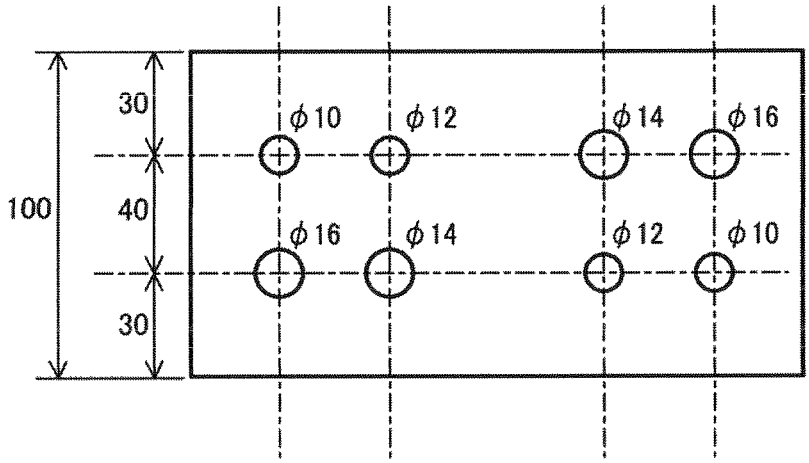
FIG. 11A is a top view of a block.
Figure 11B:
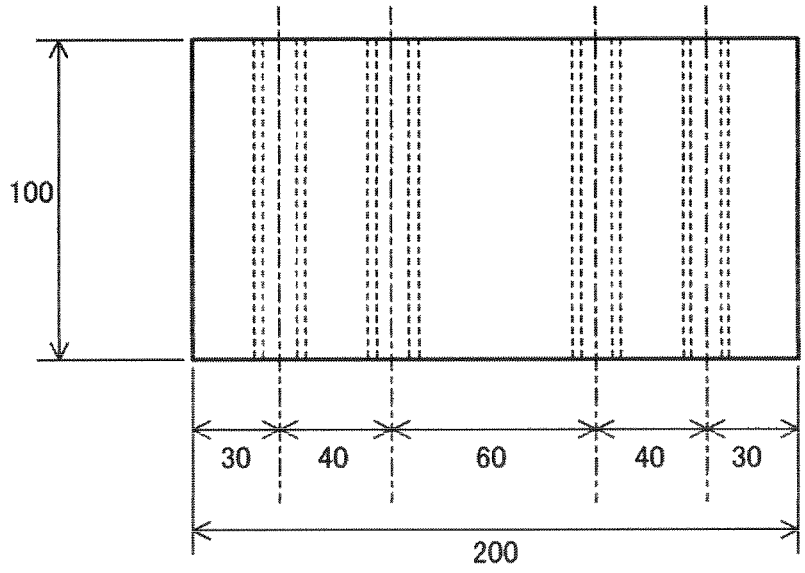
FIG. 11B is a side view of the block.
Figure 12A:
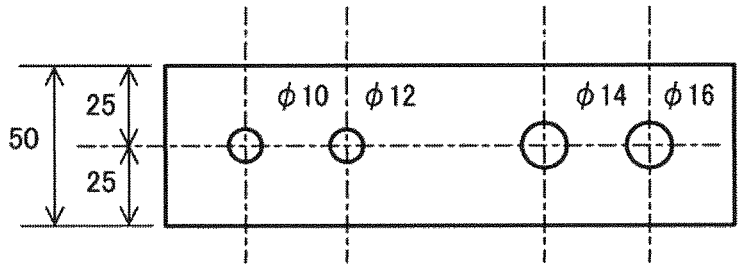
FIG. 12A is a top view of a block.
Figure 12B:
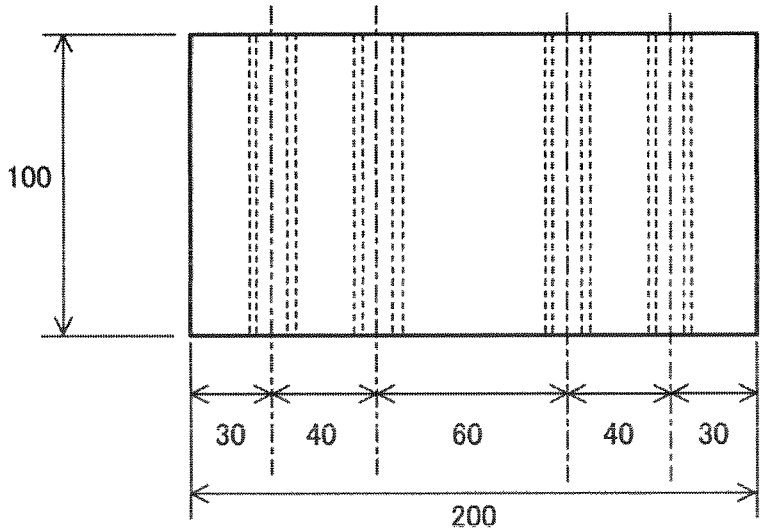
FIG. 12B is a side view of the block.
Figure 13A:
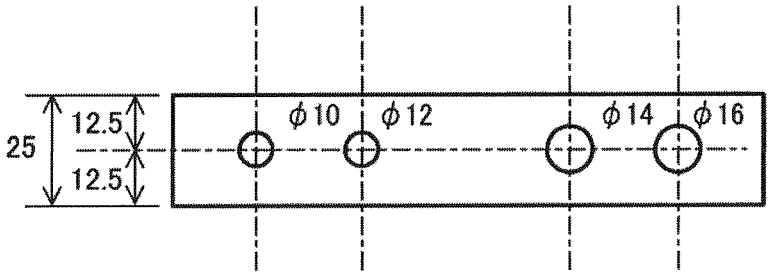
FIG. 13A is a top view of a block.
Figure 13B:
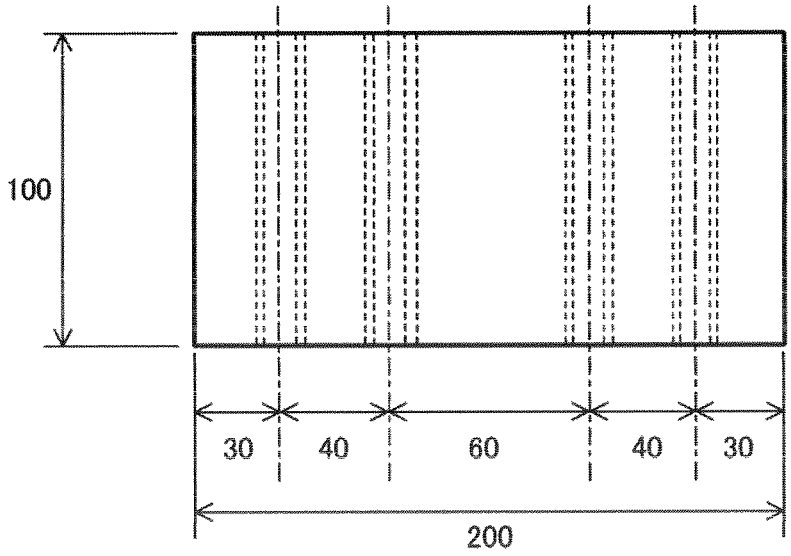
FIG. 13B is a side view of the block.

Next, concerning a case where a length of a narrow hole formed by the hole casting is set to 100 mm in each of three blocks (molds) where the short side T of the cross section orthogonal to the axial direction of the hole part has a different length, the possibility of the hole casting was evaluated while each of the coating agent, the casting sand, and the diameter of the hole part 3 are made different. The respective sizes of the three blocks are as follows in order of the short side T, the long side, and the height: 100 (mm)×200 (mm)×100 (mm); 50 (mm)×200 (mm)×100 (mm); and 25 (mm)×200 (mm)×100 (mm). FIGS. 11A and 11B respectively show a top view and a side view of the block with the 100-mm short side T. FIGS. 12A and 12B respectively show a top view and a side view of the block with the 50-mm short side T. FIGS. 13A and 13B respectively show a top view and a side view of the block with the 25-mm short side T. Table 1 shows types of the coating agent. Table 2 shows results of evaluation for the possibility of the hole casting. Note that this evaluation is performed using gray cast iron (JIS-FC250) of the same component by the same casting method.

TABLE 1

| Coating agent | Thickness t when two coats are put (mm) | Normal-temperature transverse strength σc (MPa) | Transverse strength σn after thermal treatment (MPa) |
|---|---|---|---|
| A | 1.5 | >1.5 | 0.18 |
| B | 0.9 | >4.4 | 0.62 |
| C | — | >5.0 | 0.17 |

The normal-temperature transverse strengths are catalog values, and the others are measured results.

TABLE 2

| Short side | Coating | | Diameter of hole part (mm) | | | |
|---|---|---|---|---|---|---|
| T (mm) | agent | Casting sand | 10 | 12 | 14 | 16 |
| 100 | A | Casting sand | x | x | x | ○ |
| 100 | B | Zircon sand | x | ○ | ○ | ○ |
| 100 | C | Casting sand | x | x | x | ○ |
| 50 | A | Casting sand | ○ | x | ○ | ○ |
| 50 | B | Zircon sand | ○ | ○ | ○ | ○ |
| 25 | A | Casting sand | x | ○ | ○ | ○ |
| 25 | B | Zircon sand | ○ | ○ | ○ | ○ |

A case where the inside of the hole is filled with the same type of sand as the aggregate of the mold.

As a result of the evaluation, it is found that the smaller the short side T of the block, the easier to cast the hole, even with the same type of coating agent and casting sand combined. The reason for this is as follows. When the short side T of the block becomes smaller and the solidification end time to at which the solidification of the melt ends on the periphery of the hole part becomes shorter, the decomposition of the resin constituting the coating agent has seemingly yet to end completely, namely the coating agent has seemingly yet to become the complete sintered body.

It is also found from Table 1 that the transverse strength cm of the coating agent, having been heated until decomposition of the resin to become the sintered body and then returned to room temperature, decreases to or below about one seventh of the normal-temperature transverse strength σc as a resin bonded body formed by drying the coating agent as it is. Accordingly, the transverse strength of the coating agent having yet to completely end the resin decomposition, namely yet to become a complete sintered body, is presumed to be higher than the transverse strength cm of the coating agent that has become a complete sintered body.

Figure 14:
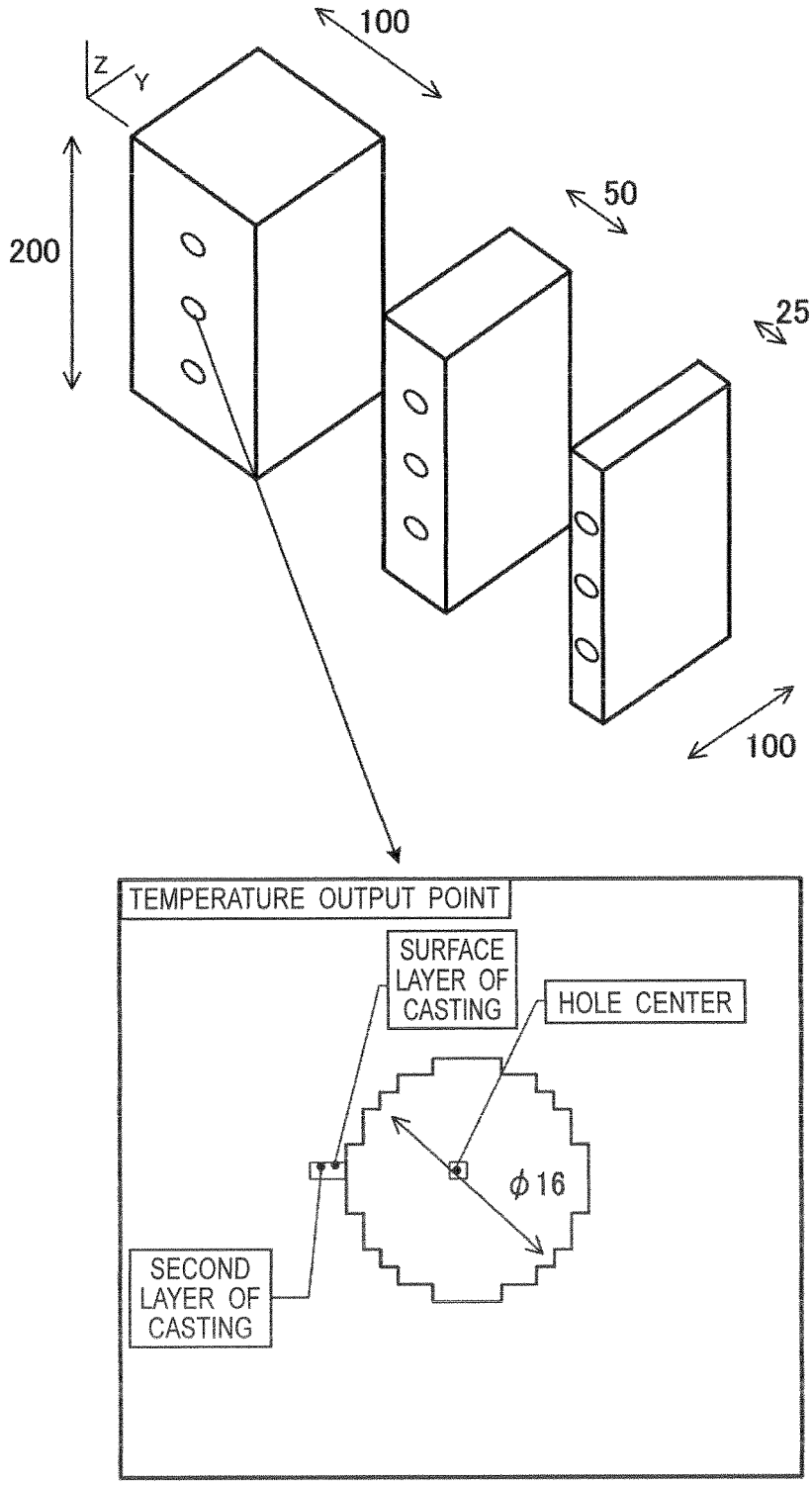
FIG. 14 is a perspective view of blocks used for analysis of solidification time.

A casting software JSCAST (QUALICA Inc.) was used to obtain solidification time on the periphery of each hole part with a diameter of 14 mm when the short sides T of the blocks are made different. FIG. 14 shows a perspective view of the blocks. The long sides and the heights of the blocks were respectively set to 100 mm and 200 mm, and the short sides T of the blocks are made different, to be respectively set to 100 mm, 50 mm, and 25 mm. In each of the blocks, the hole parts were respectively provided at a center, an upper level (a position 50 mm from the upper end surface), and a lower level (a position 50 mm from the lower end surface) in the height direction. Note that the melt was assumed to be the gray cast iron (JIS-FC250), and its physical property value is provided.

Figure 15A:
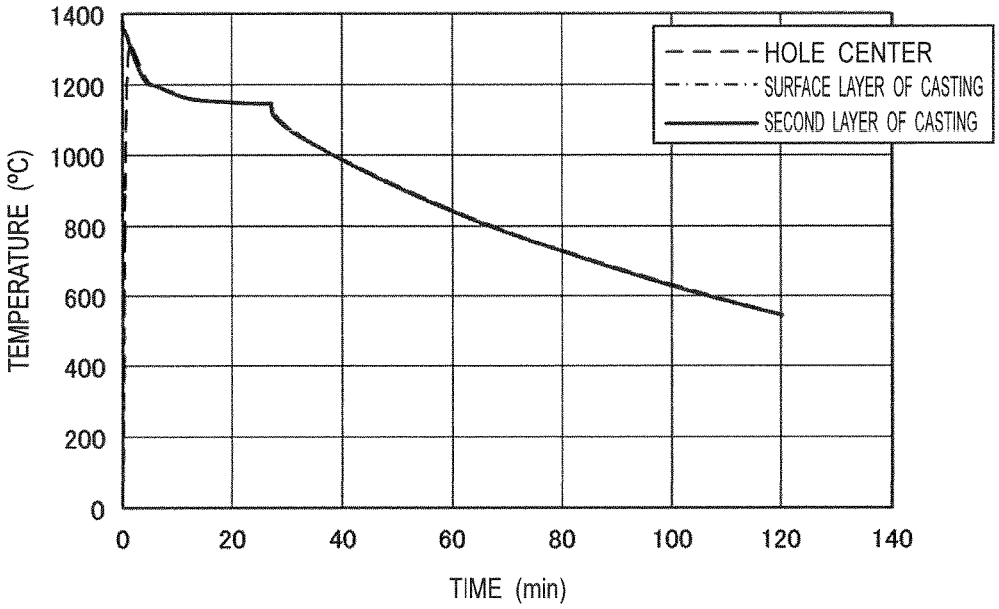
FIG. 15A is a diagram showing a cooling curve on a periphery of a hole part.
Figure 15B:
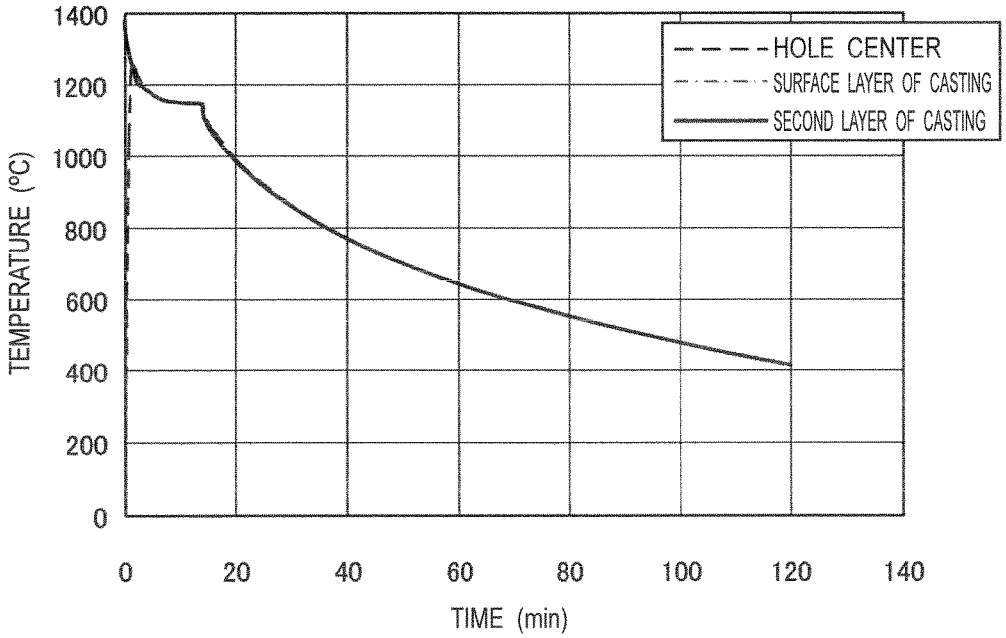
FIG. 15B is a diagram showing a cooling curve on a periphery of a hole part.
Figure 15C:
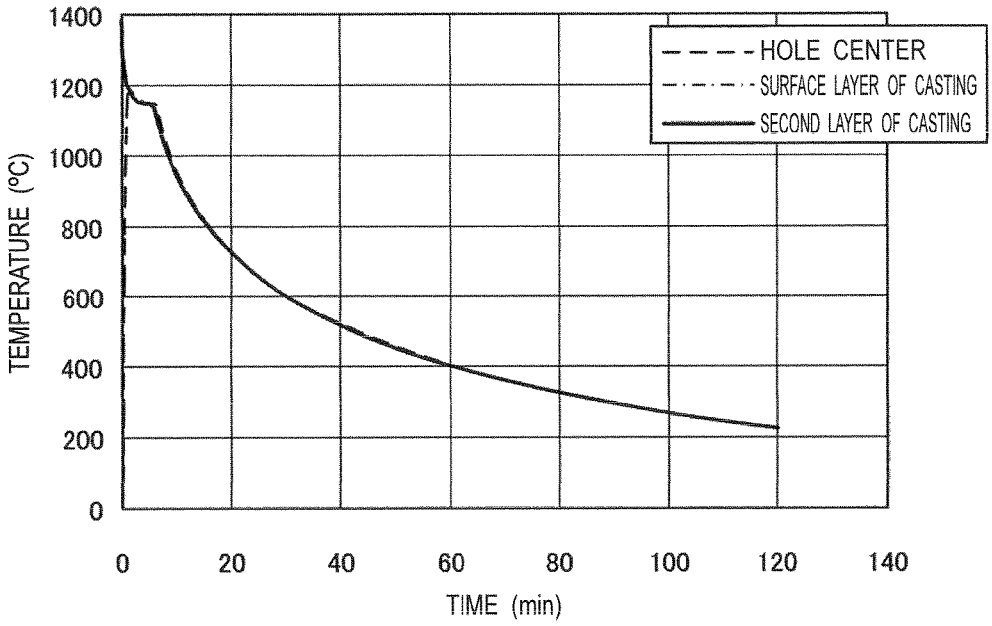
FIG. 15C is a diagram showing a cooling curve on a periphery of a hole part.

FIG. 15A shows a cooling curve on the periphery of the hole part in the block with the 100-mm short side T. FIG. 15B shows a cooling curve on the periphery of the hole part in the block with the 50-mm short side T. FIG. 15C shows a cooling curve on the periphery of the hole part in the block with the 25-mm short side T. In the figures, "Hole center", "Surface layer of casting", and "Second layer of casting" are places respectively shown in FIG. 14. Until complete solidification of the melt, the temperature of the melt decreases gently due to solidification latent heat generated at the time of solidification of the melt. After complete solidification of the melt, the temperature of the melt decreases quickly. Hence an inflection point on the cooling curve may be considered as the solidification completion time.

In FIG. 14, the block is also influenced by heat release in the height direction. Hence the solidification speed is higher in each of the hole parts provided at the upper level (the position 50 mm from the upper end surface) and the lower level (the position 50 mm from the lower end surface) than in the hole part provided at the center of the block.

Table 3 shows results of the solidification time and the evaluation for the possibility of the hole casting in each of the hole parts at the upper and lower levels and the hole part at the center provided in the block with the 100-mm short side T in FIG. 14.

TABLE 3

| | | | Solidification time (Calculation result) | | Possibility of hole casting | |
|---|---|---|---|---|---|---|
| Short side T (mm) | Coating agent | Condition of Expression (10) | Upper/ lower levels | Middle level | Upper/ lower levels | Middle level |
| 100 | A | Not satisfy | 1320 (sec) | 1635 (sec) | ○ | x |

The coating agent used in the block with the 100-mm short side T does not satisfy Expression (10). However, it is found from the experimental results shown in Table 3 that the solidification time on the periphery of the hole part at each of the upper and lower levels of the block is shorter than 1600 seconds, and a narrow hole in a good finished state can thus be cast. In contrast, it is found that the solidification time on the periphery of the hole part at the middle level of the block is longer than 1600 seconds, and a narrow hole in a good finished state thus cannot be cast. It is thus found that, even when the condition of Expression (10) is not satisfied, the "hole casting" is possible at the upper and lower levels where the solidification speed is high.

Figure 16:
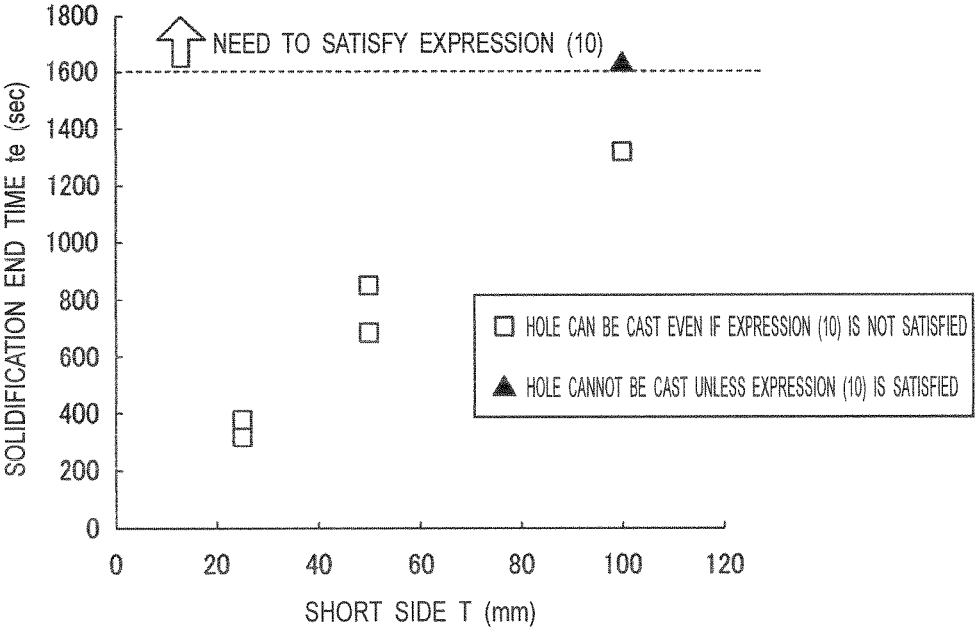
FIG. 16 is a diagram showing the relation between a short side T and a solidification end time te.

Based on the above experimental results, FIG. 16 shows the relation between the short side T and the solidification end time te. It is found from FIG. 16 that the condition of Expression (10) needs to be satisfied when the solidification end time te is 1600 seconds or larger. It is found therefrom that, since the solidification end time te needs to be within 1600 seconds, the time t0 at which the thermal decomposition of the coating agent ends can be approximated by 1600 seconds.

The hole part at the center of the block with the 100-mm short side T is a holding limit (t0≈1600 (sec)) for Expression (10). Then, two conditions are substituted into Expression (9) and simultaneous equations are solved to obtain α and β, which gives Expression (14), the two conditions being a hole casting limit for a coating agent A (a diameter of 8 mm, determined as a hole casting impossible diameter) which is a representative example of the hole casting experimental result shown in Table 2, and a diameter of 14 mm of a coating agent B.

$$\sigma b > 1.5\times10^{-4}\times1^2/t^2+160/D^2 \qquad \text{Expression (14)}$$

When the resin decomposition inside the coating agent has yet to end, namely when the solidification end time te on the periphery of the hole part is within the time t0 at which the thermal decomposition of the coating agent ends, Expression (17) is obtained using the normal-temperature transverse strength σc of the coating agent as the resin bonded body. Further, substituting t0≈1600 (sec) into Expression (17) gives Expression (18).

$$\sigma c \geq \{t0/(t0-te)\}\times(1.5\times10^{-4}\times1^2/t^2+160/D^2) \qquad \text{Expression (17)}$$

$$\sigma c \geq \{1600/(1600-te)\}\times(1.5\times10^{-4}\times1^2/t^2+160/D^2) \qquad \text{Expression (18)}$$

Hence it is found that the use of the coating agent that satisfies Expression (17) or Expression (18) can keep a coating agent from being damaged even when the casting provided with the narrow hole having a diameter of 18 mm or smaller is produced.

Figure 17:
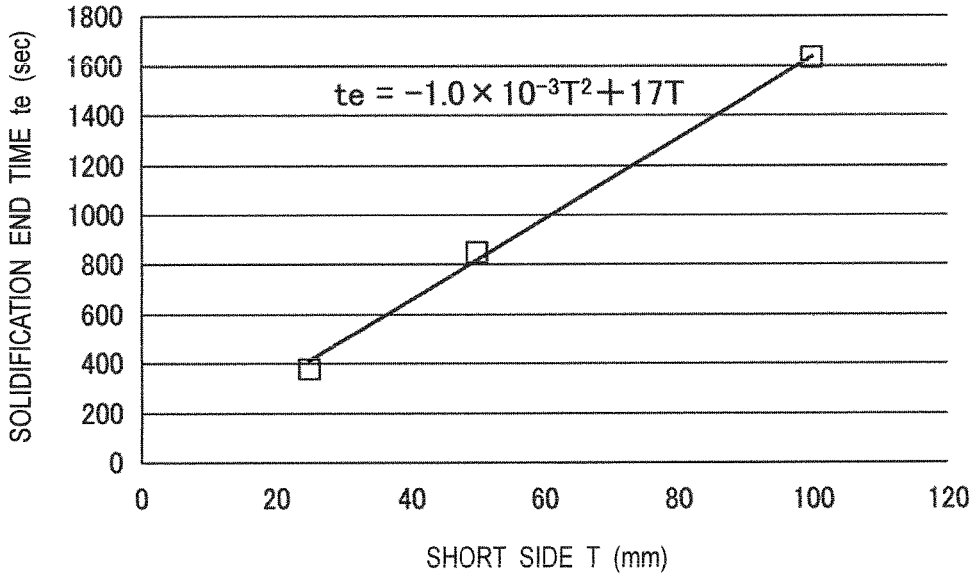
FIG. 17 is a diagram showing the relation between the short side T and the solidification end time te.
Figure 18:
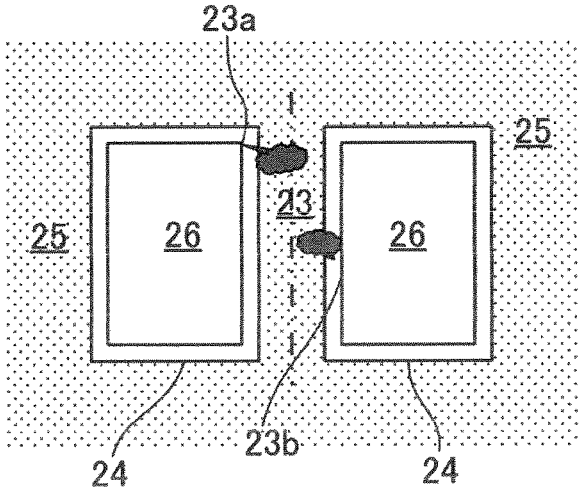
FIG. 18 is a conceptual view of casting by an evaporative pattern casting method.

Further, the numerical analysis results described above were used to obtain the relation between the short side T and the solidification end time te on the periphery of the hole part at the center of the block. FIG. 17 shows the relation between the short side T and the solidification end time te. When the common casting sand is used for casting as a measurement condition, it is found from FIG. 17 that the solidification end time te at which the solidification of the melt ends on the periphery of the hole part can be approximated by Expression (19).

$$te=-1.03\times10^{-3}T^2+16.5T \qquad \text{Expression (19)}$$

Thus, substituting Expression (19) into Expressions (17) and (18) give Expressions (20) and (21), respectively.

$$\sigma c \geq t0/(t0+1.03\times10^{-3}T^2-16.5T)\times(1.5\times10^{-4}\times1^2/t^2+160/D^2) \qquad \text{Expression (20)}$$

$$\sigma c \geq 1600/(1600+1.03\times10^{-3}T^2-16.5T)\times(1.5\times10^{-4}\times1^2/t^2+160/D^2) \qquad \text{Expression (21)}$$

Accordingly, it is found that the use of the coating agent that satisfies Expression (20) or Expression (21) can keep the coating agent from being damaged even when the casting provided with the narrow hole having a diameter of 18 mm or smaller is produced.

EXAMPLE

Next, a casting provided with a narrow hole was produced by using gray cast iron (JIS-FC250) as a melt and using a mold, formed by providing in a foam pattern in a rectangular parallelepiped shape of 50 (mm)×100 (mm)×200 (mm) a hole part that has a length of 100 mm and a diameter of 14 mm and penetrates the foam pattern from its upper surface to lower surface.

Substituting T=50 (mm), 1=100 (mm), and D=14 (mm) into Expression (21), and further substituting thereinto t=0.9 (mm) as a standard thickness obtained by putting two coats of the coating agent B of Table 1, made the right side become 5.7. The normal-temperature transverse strength σc of the coating agent B is larger than 4.4 MPa, but may be 5.7 Mpa or smaller, and the hole casting is likely impossible. Then, three coats of the coating agent B were put to make the thickness t become 1.4 mm, thereby satisfying Expression (21).

As a result of putting the three coats of the coating agent B on the foam pattern and then performing casting, a narrow hole in a good finished state was able to be cast without occurrence of the "burning."

(Effect)

As described above, in the evaporative pattern casting method according to the present embodiment, at the time of producing the casting provided with the hole having a diameter of 18 mm or smaller and a length of 1 (mm), the coating agent that satisfies Expression (17) above is used when the solidification end time to (sec) at which the solidification of the melt ends on the periphery of the hole part is within the time t0 at which the thermal decomposition of the coating agent ends. In this context, directly measuring the strength of the coating agent at high temperature is difficult. However, the transverse strength of the coating agent, having been heated until the decomposition of the resin to become the sintered body and then returned to room temperature, decreases to or below about one seventh of the normal-temperature transverse strength as the resin bonded body formed by drying the coating agent as it is. Hence the transverse strength of the coating agent having yet to end the resin decomposition completely, namely yet to become the complete sintered body, is presumed to be higher than the transverse strength of the coating agent that has become the complete sintered body. The strength of the coating agent as the resin bonded body is σc at room temperature, which decreases with the progress of thermal decomposition of the resin, and becomes 0 at a decomposition rate of 100%. However, when the solidification end time te (sec) at which the solidification of the melt ends on the periphery of the hole part is within the time t0 (sec) at which the thermal decomposition of the coating agent ends, the strength as the resin bonded body remains in the coating agent. Considering the strength as the coating agent which remains in the resin bonded body, Expression (17) above is obtained. The use of the coating agent that satisfies Expression (17) above can thus keep the coating agent from being damaged even when the casting provided with the narrow hole having a diameter of 18 mm or smaller is produced. This prevents occurrence of the burning during casting, to allow casting of the narrow hole having a diameter of 18 mm or smaller and being in a good finished state.

Since the time t0 at which the thermal decomposition of the coating agent ends is 1600 seconds, when the solidification end time te (sec) at which the solidification of the melt ends on the periphery of the hole part is within 1600 seconds, the strength as the resin bonded body remains in the coating agent. At this time, the use of the coating agent that satisfies Expression (18) above can thus keep the coating agent from being damaged.

The solidification end time to at which the solidification of the melt ends on the periphery of the hole part can be expressed by Expression (19) above as a function of the short side T of the cross section in the mold which is orthogonal to the axial direction of the hole part. Accordingly, when this relation is satisfied, the use of the coating agent that satisfies Expression (20) or (21) above can keep the coating agent from being damaged.

Although the embodiment of the present invention has been described above, that has merely illustrated a specific example and does not particularly restrict the present invention, and a specific configuration and the like can be changed in design as appropriate. The actions and effects described in the embodiment of the invention are merely a list of the most preferable actions and effects provided by the present invention, and the actions and effects of the present invention are not restricted to those described in the embodiment of the present invention.

The invention claimed is:

1. An evaporative pattern casting method for producing a casting provided with a hole having a diameter of 18 mm or smaller and a length of 1 (mm) by burying into casting sand a mold, which is formed by application of a coating agent to a surface of a foam pattern, and then pouring a metal melt into the mold to cause the foam pattern to disappear and be replaced with the melt, wherein assuming that a thickness of the coating agent applied to the foam pattern is t (mm), a diameter of a hole part in the foam pattern, which is a portion to be formed with the hole, is D (mm), and a normal-temperature transverse strength of the dried coating agent is σc (MPa), the coating agent that satisfies the following expression is used when a solidification end time te (sec) at which solidification of the melt ends on a periphery of the hole part is within a time t0 (sec) at which thermal decomposition of the coating agent ends.

$$\sigma c \geq \{t0/(t0-te)\} \times (1.5\times10^{-4}\times1^2/t^2+160/D^2)$$

2. The evaporative pattern casting method according to claim 1, wherein the time t0 at which the thermal decomposition of the coating agent ends is 1600 seconds.

3. The evaporative pattern casting method according to claim 1, wherein a shape of the mold is a rectangular parallelepiped, and the following expression is satisfied when a short side of a cross section in the mold, which is orthogonal to an axial direction of the hole part, is assumed to be T.

$$te=-1.03\times10^{-3}T^2+16.5T$$

4. The evaporative pattern casting method according to claim 2, wherein a shape of the mold is a rectangular parallelepiped, and the following expression is satisfied when a short side of a cross section in the mold, which is orthogonal to an axial direction of the hole part, is assumed to be T.

$$te=-1.03\times10^{-3}T^2+16.5T.$$

* * * * *